US005090618A

United States Patent [19]

Newton

[11] Patent Number: 5,090,618

[45] Date of Patent: Feb. 25, 1992

[54] RAIL JOINT

[76] Inventor: Alan Newton, 67 Bluebird Ave., East Wareham, Mass. 02538

[21] Appl. No.: 563,042

[22] Filed: Aug. 6, 1990

[51] Int. Cl.[5] ..... E01B 11/00

[52] U.S. Cl. ..... 238/218; 238/225

[58] Field of Search ..... 238/151, 187, 195, 218, 238/219, 221, 223, 224, 225, 227, 229, 230

[56] References Cited

U.S. PATENT DOCUMENTS

| | | | |
|---|---|---|---|
| 210,705 | 12/1878 | Neff | 238/218 |
| 675,645 | 6/1901 | Wood | 238/225 |
| 750,736 | 1/1904 | Urbanitzky | 238/218 X |
| 972,148 | 10/1910 | Bacon et al. | 238/218 X |
| 1,004,067 | 9/1911 | Papendry | 238/218 |
| 1,041,403 | 10/1912 | Bacon et al. | 238/225 X |
| 1,378,425 | 5/1921 | Rosebrook | 238/218 X |

*Primary Examiner*—Frank E. Werner

*Assistant Examiner*—James Eller

*Attorney, Agent, or Firm*—Wolf, Greenfield & Sacks

[57] ABSTRACT

Two rails are disposed in a direction of wheel travel and joined at their ends so as to permit continuous rolling of the wheel from one rail to the other. These rails maintain the wheel at a predetermined elevation, and the ends have a gap therebetween. The wheel is supported in a region overlapping the gap at an elevation equal to the predetermined elevation of the rails without any significant drop of the wheel into the gap. The wheel may be elevated to maintain the predetermined elevation by contacting a rolling surface location thereon, differing from that normally contacted by at least one of the two rails. The wheel may also be elevated over the gap by a support positioned along the side of at least one of the two rails that extends outward away from the end of the rail in the direction of wheel travel.

16 Claims, 6 Drawing Sheets

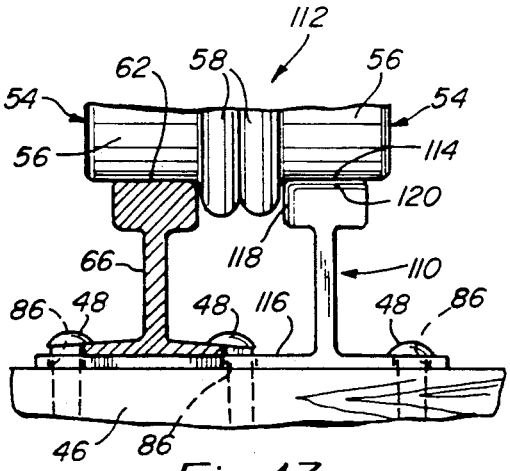
Fig. 13
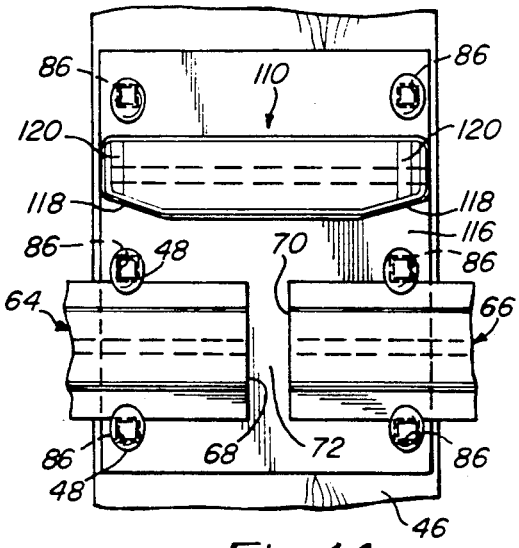
Fig. 14
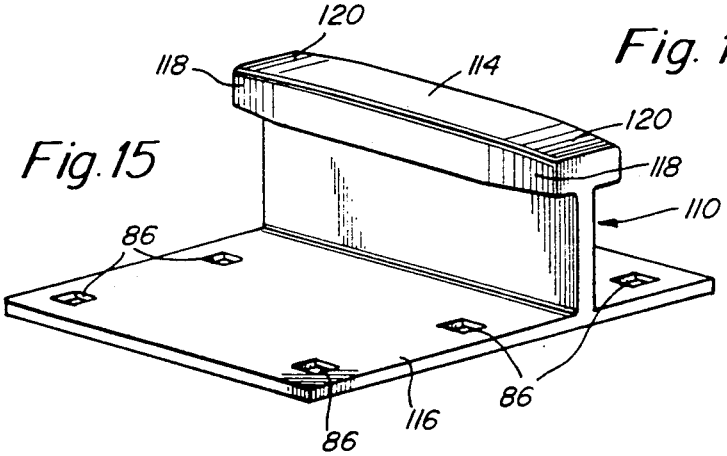
Fig. 15
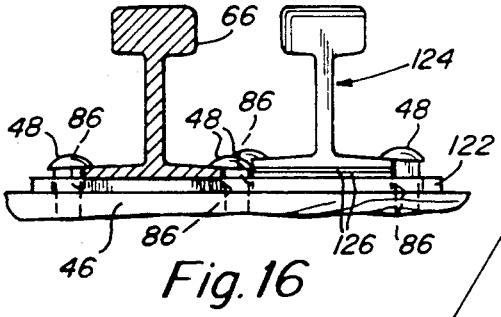
Fig. 16
Fig. 17
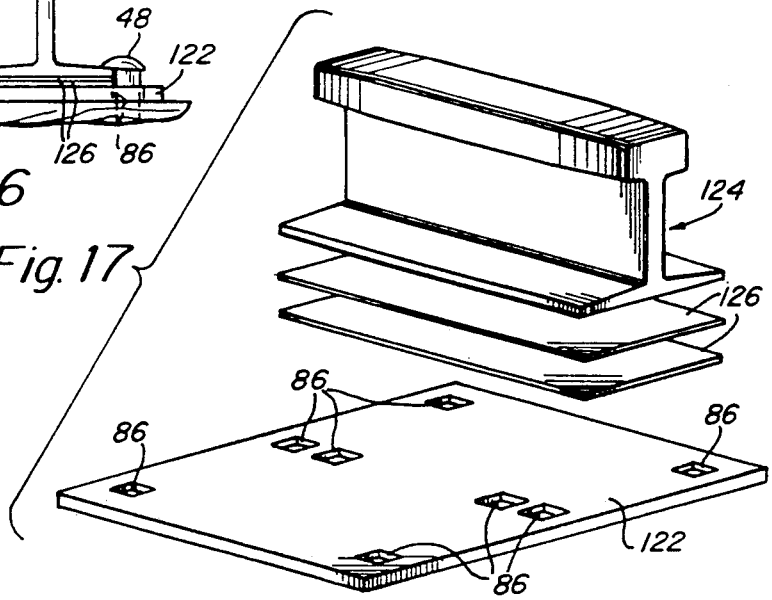

RAIL JOINT

FIELD OF THE INVENTION

This invention relates to a rail joint and, more particularly, a joint system that allows a wheel to ride smoothly from one rail to another.

BACKGROUND OF THE INVENTION

A significant problem in the construction of rail systems is the joining of individual rails to form a track. A traditional method of joining rails in linear alignment is depicted in FIGS. 1(A) and 1(B). Such joining has involved the positioning of two rails 30 and 32 in linear alignment with their ends 34 and 36 abutting one another. A gap 38 is disposed between the two ends 34 and 36 that allows for thermal expansion. Such expansion may be significant in regions where large temperature changes occur over the course of the year. The two rails are maintained in alignment by means of a pair of splice plates 40 bolted through the sides of the rail and resting upon the upright rail web 42. Note that the splice plates include slots 44 to allow for displacement of the rails relative to the plates due to thermal expansion and contraction.

The joined rail unit is also secured to a tie 46 using a set of spikes 48 driven therethrough that hold the rail flush against an aligning spike plate 50 disposed between the rail base 52 and the tie surface. The figures also illustrate a traditional metallic railroad wheel 54 having a rolling surface 56 that contacts the rail top surface and a guiding flange 58 that contacts the inner facing side of the rail. This wheel must travel over countless numbers of joints having gaps 38 as it travels from one point to another and this gap traversal may cause problems.

A particular problem associated with these gaps is clearly depicted in FIG. 2. Each time a railroad wheel 54 traverses a gap 38 between two rails 30, 32, a discrete arc 60 of the wheel surface drops into the gap 38, falling a distance D below the top surface 62 of the rail. The larger the gap distance G, the greater the drop distance D. One particular problem associated with gaps is the considerable loss of ride smoothness. This smoothness of ride is critical in very high speed train applications. This may be a significant concern in passenger transport, especially in the case of "bullet trains" currently proposed in the U.S. and other countries. Of equal concern in either passenger or especially freight transport is the energy loss resulting from the traversal of gaps. Assuming that each wheel supports at least 5,000 pounds and that each wheel drops 0.010 inches, and that rail gaps are spaced at 125 per mile, then a car with eight wheels in rising back out of each gap will expend energy equivalent to lifting 5,000 pounds approximately ten inches for each mile of horizontal travel. Assuming that a train has at least twenty cars, then the rise will equal 200 inches per mile for every 5,000 pounds carried by the train. Thus, for a large heavy train, the amount of energy expended simply in traversing joint gaps is significant.

In some very temperature stable regions of the country it may be possible to reduce the effect of gaps by joining rail ends closely together. However, wherever any significant degree of temperature change is encountered, sizable joint gaps are necessary for all discrete sections of rail to be joined together. This is because thermal expansion would otherwise deform closely abutting rails. Therefore, one solution to the problem of joint gaps is the elimination of joints themselves through welding of rail ends together or other permanent joining processes. This system has a clear drawback in that it is a fairly expensive process and renders repairs and replacement of rail sections significantly more difficult.

SUMMARY OF THE INVENTION

It is therefore an object of the present invention to provide a rail joint with which a wheel is supported over a gap between two rails without any significant drop into the gap.

It is another object of this invention to provide a rail joint that is suitable for high speed travel.

It is yet another object of the present invention to provide a rail joint that may be used with existing rail hardware and construction techniques, as well as existing rolling stock.

This invention provides a rail joint having two rails disposed in a direction of wheel travel and joined at their ends so as to permit continuous rolling of the wheel from one rail to the other. The rails maintain the wheel at a predetermined elevation and the ends have a gap therebetween. There are means for supporting the wheel in a region overlapping the gap at an elevation equal to the predetermined elevation without a significant drop of the wheel into the gap.

In a preferred embodiment the means for supporting includes a means for elevating the wheel by contacting a rolling surface location thereon differing from that normally contracted by at least one of the two rails. The means for elevating is positioned alongside at least one of the two rails, beyond its end. This means for elevating may include a means for contacting an outer disposed rolling surface of the wheel at a level that maintains the wheel at the desired predetermined elevation. The means for elevating may also include a means for carrying a guiding flange of the wheel to maintain the wheel at the desired predetermined elevation. The means for contacting may include a reinforcing web connected perpendicularly to the contacting means that passes through the gap at a non interfering elevation relative to the rolling of the wheel. This reinforcing web may be connected to the means for carrying the guiding flange wherein both a means for contacting and a means for carrying are included in the same framework. In any of the arrangements having a means for carrying, a means for contacting or both, an integrally formed spike plate may be included.

In an alternative embodiment the means for elevating may include a means for alternately staggering the two rails inwardly and outwardly so that a part of the rolling surface of the wheel alternately contacts either inwardly staggered or outwardly staggered rails. This means for alternately staggering may include a spike plate to align each of the rail ends in a staggered overlapping relationship. At least one of these rails may include a tapered side proximate to its end for allowing a smooth transition of a guiding flange of a wheel rolling onto it.

In another alternative embodiment the means for supporting may include wedge means located in substantial linear alignment with one of the two rails and having a gap between the rail and the wedge means that completely separates the rail from the wedge means. This gap is diagonal to the direction of wheel travel.

The wedge means may additionally include a second gap that is diagonal to the direction of wheel travel and completely separates another of the two rails from the wedge means. Any one of the means for elevating in any of the embodiments may include at least one ramp means in the direction of wheel travel that tapers to a level below that required to maintain the wheel at the desired predetermined elevation. The wedge means may also include such a ramp means.

BRIEF DESCRIPTION OF THE DRAWINGS

The foregoing objects and advantages of the present invention will be more clearly understood in connection with the accompanying drawings in which:

FIG. 13 is a cross sectional front view of another alternative embodiment of a gapless rail joint according to this invention utilizing oppositely-facing rolling surface double wheel pairs;

FIG. 14 is a top view of the gapless rail joint of FIG. 13;

FIG. 15 is a perspective view of an integrally formed gapless rail joint of FIG. 13 with rails removed;

FIG. 16 is a cross sectional front view of an alternative multi piece construction for the gapless rail joint of FIG. 13;

FIG. 17 is an exploded perspective view of the alternative multi-piece construction of FIG. 16;

DETAILED DESCRIPTION OF THE PREFERRED EMBODIMENTS

Figure 1A:
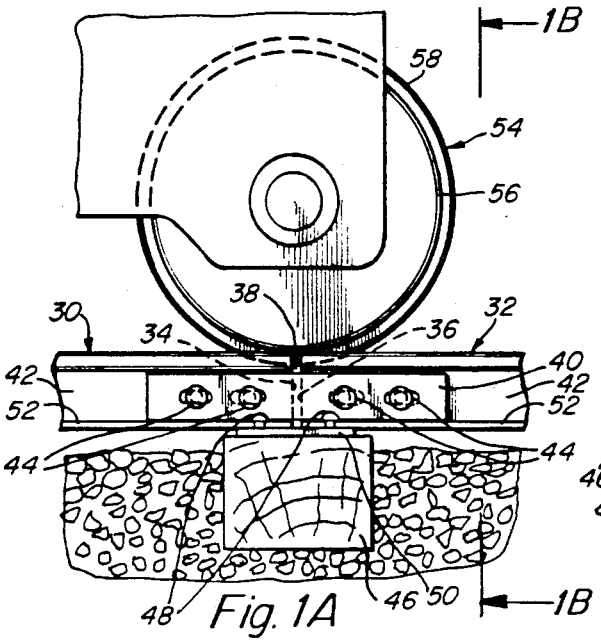
Fig. 1A (PRIOR ART)
FIG. 1(A and B) shows a prior art rail joint with a gap and a standard wheel traversing the gap.
Figure 1B:
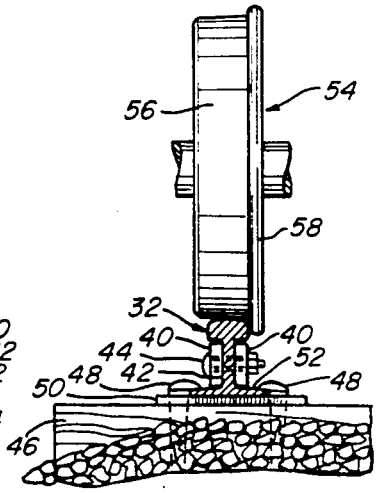
Fig. 1B (PRIOR ART)
Figure 2:
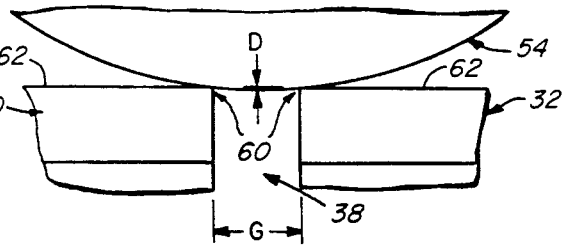
Fig. 2 (PRIOR ART)
FIG. 2 shows the relative drop of a wheel into a gap between rails joined according to the prior art.
Figure 3:
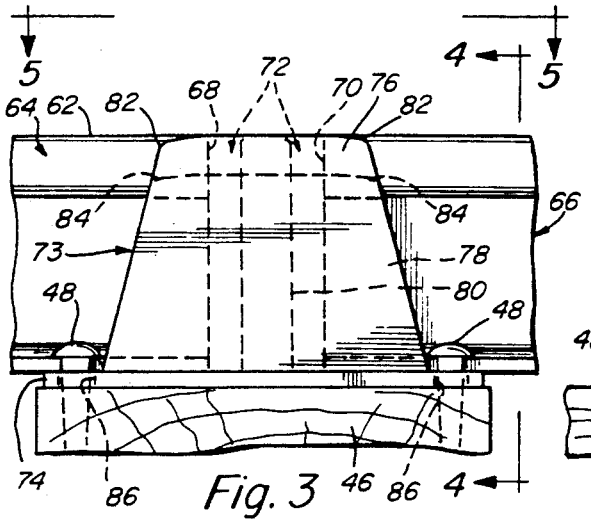
FIG. 3 is an exposed side view of a preferred embodiment of a gapless rail joint according to this invention.

A preferred embodiment for a gapless rail joint according to this invention is depicted in FIG. 3. The joint comprises of two linearly aligned rails 64 and 66 secured to a tie 46 by means of spikes 48. Between the ends 68 and 70 of these rails is disposed a gap 72. This gap is bridged at its side by a supporting frame 73 consisting of a base plate 74 below the rails, outer rolling surface support 76 along the outer facing rail side, guiding flange support 78 along the inner facing rail side and web 80 interconnecting the two supports through the gap 72. The support 76 overlaps the gap and extends outward past both rail ends 68, 70. This arrangement is shown in greater detail in cross section in FIG. 4, which depicts how the wheel 54 is supported on surfaces other than those normally supported by the rail 66. The flat top surface of the outer rolling surface support 76 contacts part of the wheel rolling surface 56 that extends axially outward beyond the edge of the rail. Similarly, the guiding flange support 78 includes a trough 81 along its top surface to more positively direct the wheel guiding flange 58 over the gap.

Figure 4:
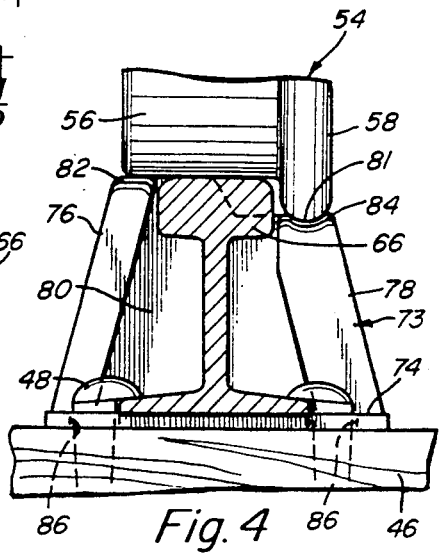
FIG. 4 is a cross sectional front view of the gapless rail joint of FIG. 3.

FIGS. 3 and 4 also clearly depict a pair of oppositely disposed tapered top edges 82 and 84 upon each support that fall below the level of the rail top 62. These tapered edges act as ramps, allowing a smooth transition of the wheel from support of its rolling surface by the rail to support of its flange and outer rolling surface in the region overlapping the gap. The center region of each of the supports 76 and 78 is set at an elevation that allows each respective supported wheel surface to maintain the same height it has upon each of the rails in the region of the gap.

Figure 5:
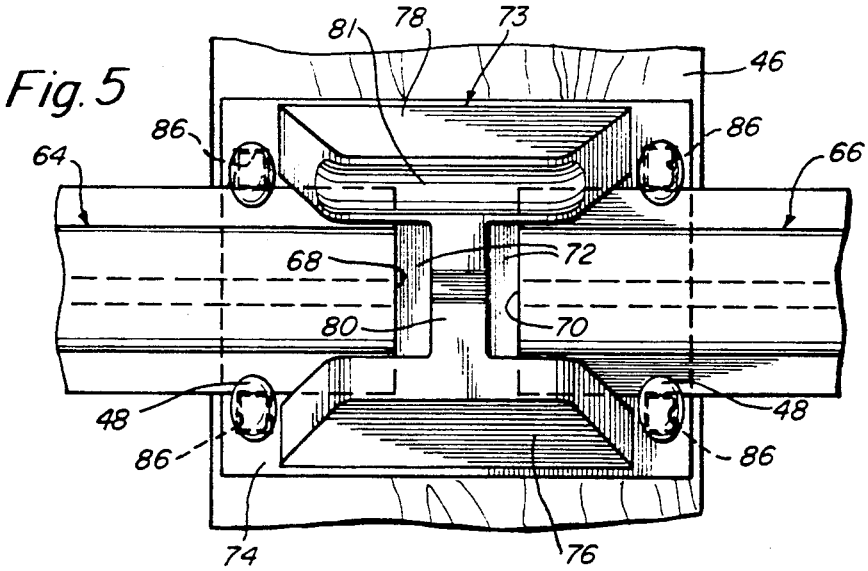
FIG. 5 is a top view of the gapless rail joint of FIG. 3.

The frame 73 of FIG. 3 is shown in top view in FIG. 5. The gap 72 is traversed by a reinforcing web 80 perpendicular and attached to each support, thus forming an "H". This web stands no higher than the top surface of the rail, and thus, does not interfere with travel of the wheel over the gap. Also visible is the base plate 74 with its four spiking holes. It, thus, performs an aligning function similar to a normal alignment spike plate as disclosed in the prior art. However, the spike holes 86 of the frame base plate 74 serve a dual purpose in both securing the rails to the tie 46 and aligning the frame 73 with respect to the rails.

Figure 6:
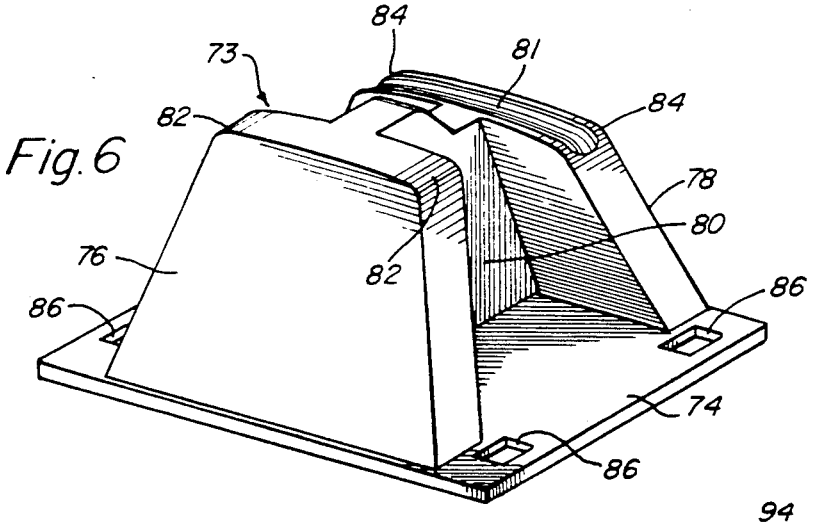
FIG. 6 is a perspective view of the gapless rail joint of FIG. 3 with rails removed.
Figure 7:
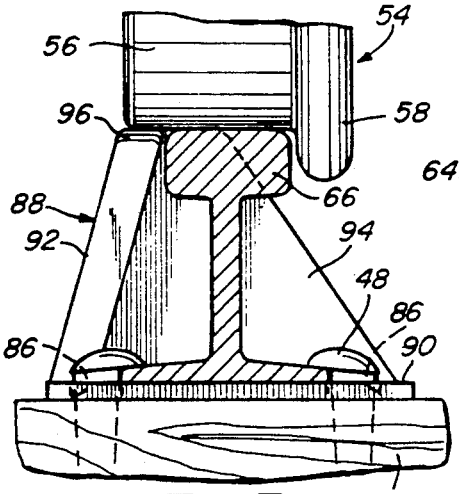
FIG. 7 is a cross sectional front view of an alternative embodiment for a gapless rail joint according to this invention.
Figure 8:
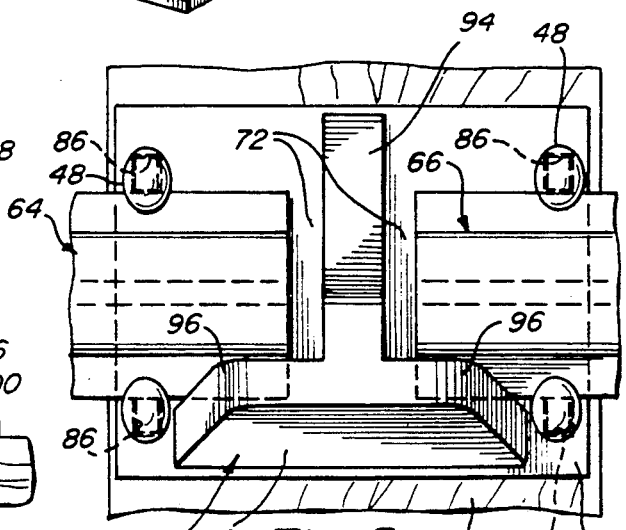
FIG. 8 is a top view of the gapless rail joint of FIG. 7.
Figure 9:
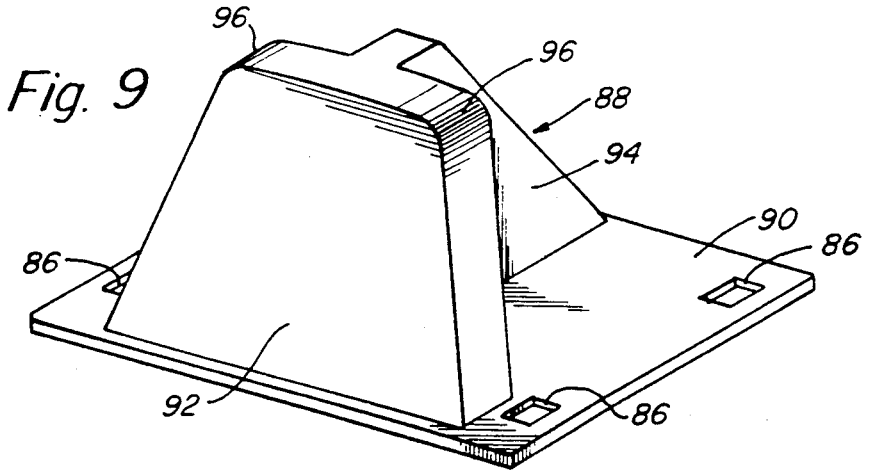
FIG. 9 is a perspective view of the gapless rail joint of FIG. 7 with rails removed.

The supporting frame 73 according to this embodiment may be constructed as an integral unit including an attached base plate 74, as depicted in the perspective view of FIG. 6. This frame and others described further below are constructed preferably of rail grade steel and may be cast as a single unit, or welded and otherwise joined together from individual components. Thus, this unit may be easily adapted to existing railroad rights of way and requires no specific modifications of rails or wheels on rolling stock. Such support frames may, in fact, be installed as replacement alignment plates during an ordinary track maintenance program.

Where there may be concern that wheel guiding flanges may not all be of like radius in a group of rolling stock, it may be desirable to implement a variation of the embodiment of FIGS. 3-6. The support frame 88 depicted in FIG. 7 consists of a base plate 90, outer rolling surface support 92 and interconnected perpendicular reinforcing web 94. Note that no flange support is utilized. The system is configured similarly to that of FIGS. 3-6, as illustrated by the top view of FIG. 8, in that the web 94 traverses the gap 72. However, the system only carries the outer facing rolling surface of the wheel over the gap. Thus, the guiding flange 58 of the wheel may be of any usable radius. As shown in the perspective view of FIG. 9, this embodiment also contains tapered ramps 96 to provide a smooth transition of the wheel onto the support over the gap. Additionally, this unit may be constructed integrally to include a spiking base plate.

Figure 10:
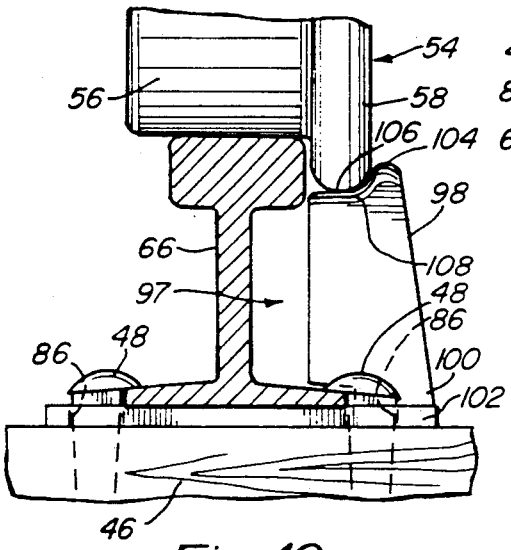
FIG. 10 is another alternative embodiment for a gapless rail joint according to this invention.
Figure 11:
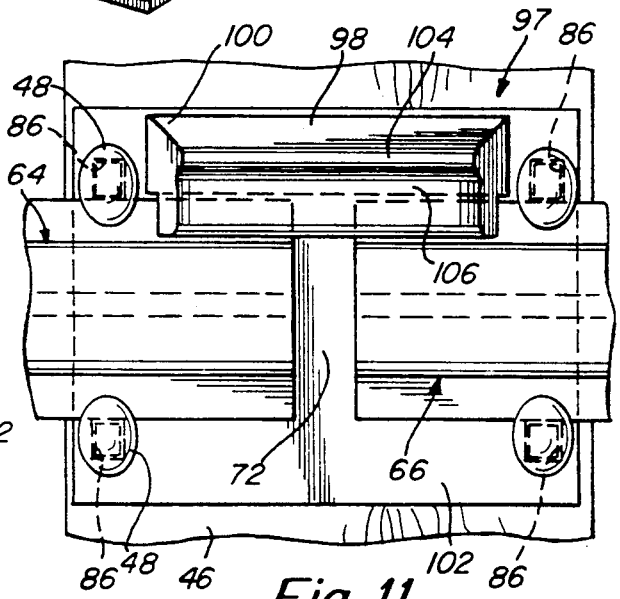
FIG. 11 is a top view of the gapless rail joint of FIG. 10.
Figure 12:
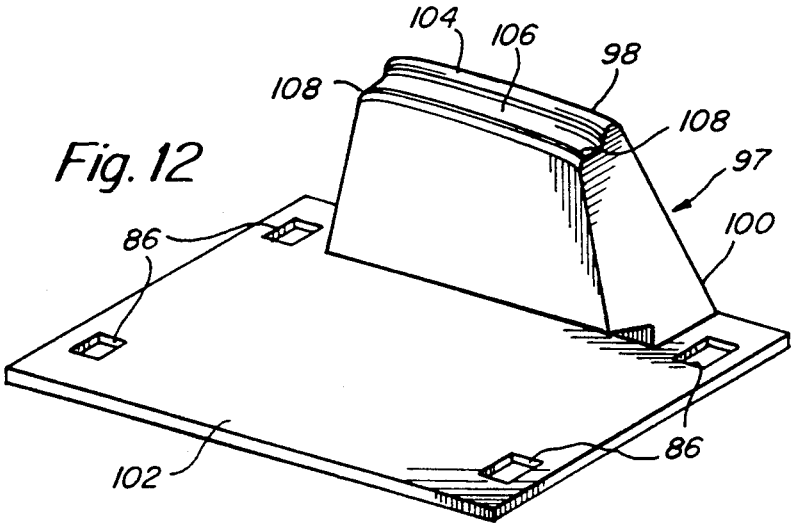
FIG. 12 is a perspective view of the gapless rail joint of FIG. 10 with rails removed.

Another variation of the embodiment of FIGS. 3-6 is depicted in FIGS. 10-12. This frame 97 consists of only one support 98 that supports a wheel 54 only upon its guiding flange 58 in the region of the gap 72. The particular example depicted contains no reinforcing transverse web. Rather, a sturdy support base 100 connected to the base plate is utilized. The support 98 also includes a raised guide lip 104 disposed opposite to the rail 66. The guide lip serves to maintain the flange in alignment relative to the direction of wheel travel as it passes over the gap. As in the embodiment of FIGS. 3-6 having a guiding flange support, the upper surface of the support 98 may also include a trough shape 106 generally conforming to the curved surface of a flange to aid in guiding the wheel linearly. The frame 98 may also include a pair of oppositely disposed tapered ramps 108 oriented in the direction of wheel travel to provide a smooth transition of the wheel flange 58 onto the bridging support 98.

An alternative embodiment of a gap support frame is depicted in FIGS. 13-15. In this example, the gap supporting structure 110 is configured in roughly the same manner as the rail 66 itself. A cross sectional front view (FIG. 13), depicts the rail and the supporting structure in a side-by-side relationship. A special double wheel arrangement 112, consisting of two oppositely facing standard wheels 54 with their flanges 58 abutting one another, between the rail and the supporting structure, is utilized in this embodiment. The top surface 114 of the supporting structure 110 is positioned at the same elevation as the rail top surface 62, and the rolling surfaces 56 of each of the two wheels 54 are of similar radius.

FIG. 14 depicts the frame layout more clearly with a top view of the support and rails. The supporting structure 110 is connected to an integral base plate 116 that contains six spike holes 86. Four of these spike holes are disposed proximate to the rails 64 and 66 and facilitate the locating of spikes 48 to secure the rails to the tie 46 in linear alignment with each other. A standard distance gap 72 is disposed between the rail ends 68 and 70. The supporting structure 110 has tapered edges 118 along its sides. These edges insure that the wheel guiding flange 58 facing the supporting structure 110 will not damage the structure in the event of slight misalignments of the wheel relative to the rail as it rolls onto the supporting structure. As shown in a perspective view in FIG. 15, the supporting structure 110 also includes tapered ramps 120 along its top surface to allow a smooth transition of the wheel rolling surface as it passes over the gap 72. As in other gap joint systems disclosed herein, the supporting structure may be formed integrally with the base plate.

The supporting arrangement of FIGS. 13-15 may also be constructed from separate components. This is illustrated in FIGS. 16-17. The cross sectional front view of FIG. 16 depicts a base plate 122 with eight separate holes 86 to which is spiked a pair of joined rails 64, 66 and a separate supporting structure 124. This supporting is actually separately spiked to the base plate 122. The height of the supporting structure may be varied by placing a predetermined number of shims 126 below it prior to spiking it in place. This allows for adjustment of the supporting structure elevation to account for wheels having variable radius (conical shape) along their axial direction. Note that like the supporting structure 110 of FIGS. 13-16, this supporting structure 124 also includes tapered sides and tapered top surface ramps. A supporting structure according to this embodiment may be formed from a piece of standard rail stock, cut and ground to shape. As such, no welding or special casting is required to build a gapless rail joint in this manner.

Figure 18:
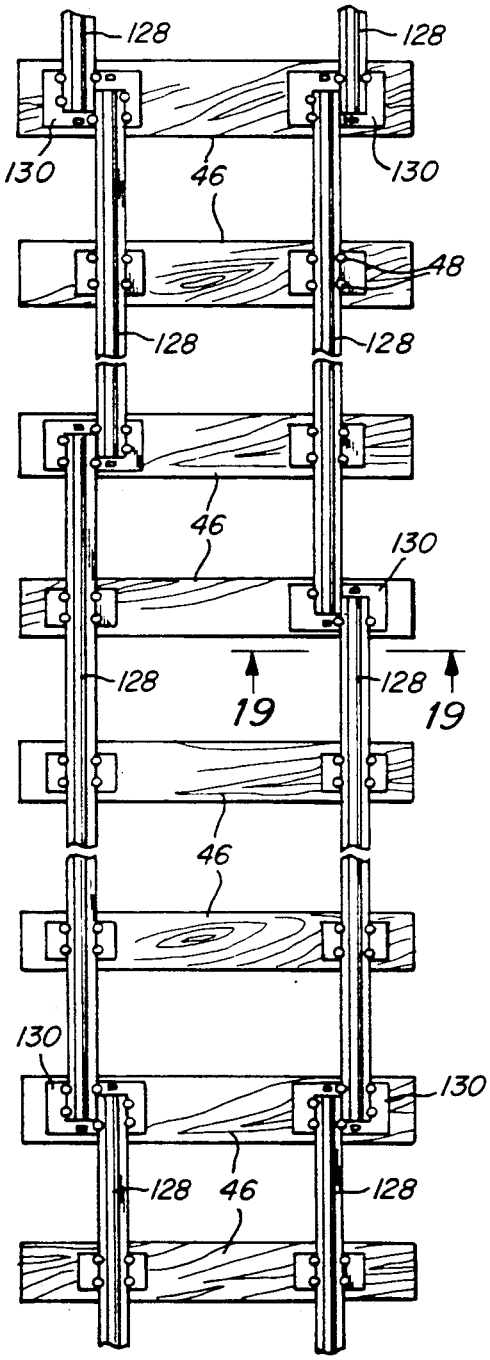
FIG. 18 is a top view of an alternative embodiment of a gapless rail joint according to this invention utilizing a specialized staggering technique and center flanged, oppositely-facing, rolling surface wheels.
Figure 19:
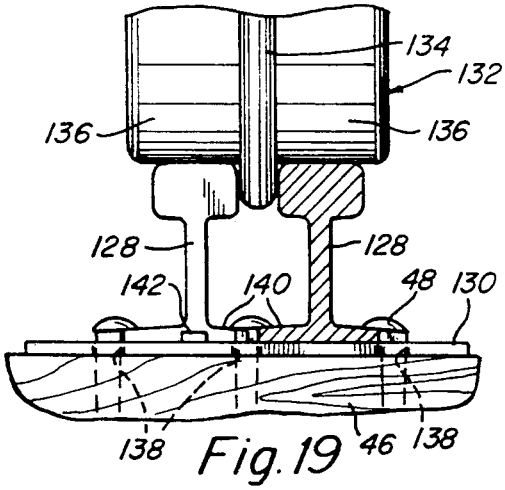
FIG. 19 is a cross sectional front view of the gapless rail joint of FIG. 18.

An equally effective system for eliminating rail gaps involves unique placement of the rails themselves. Such a system is depicted in FIG. 18. A series of staggered rails 128 are joined at their ends such that the ends of each rail are overlapping the sides of each other rail for a relatively small distance. The rails are staggered lying inwardly and outwardly from the track central region in an alternating pattern. This staggering arrangement is possible due to special joining base plates 130, placed upon the ties 46, that allow the ends of rails to be spiked down aside each other. Spike plates 50 along the track between each special joining base plate 130 are of conventional design. The rails are joined aside one another in relatively close proximity. Thus, an oppositely facing standard wheel pair such as that depicted in FIG. 13 may not have a narrow enough flange. As such, a specially designed wheel 132, as depicted in FIG. 19, having a centrally located flange 134 and oppositely facing rolling surfaces 136 may be employed. At any given time, at least one of these rolling surfaces 136 will contact the top surface of a staggered rail of FIG. 18. As transitions between staggered rails occur at the joints, the wheel at one point in time contacts both overlapping rails. At no time, however, is the wheel subjected to a gap or area in which it is not fully supported by at least one rail.

Figure 20:
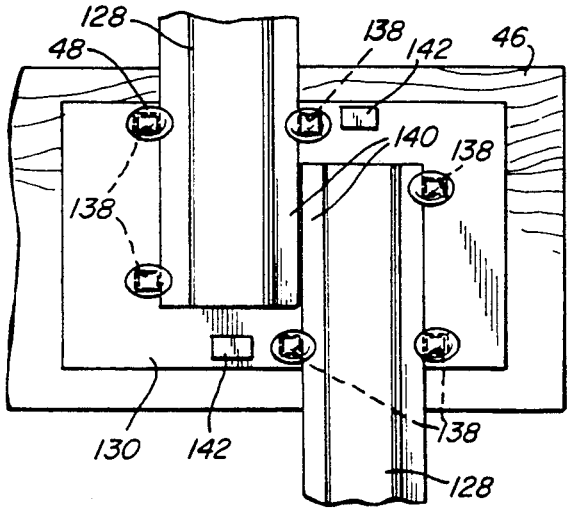
FIG. 20 is a more detailed top view of a single joint for the gapless rail joint of FIG. 18.

The joining base, plate 130 is shown in greater detail in FIG. 20. The joining base plate 130 is generally constructed with two sets of three staggered spiking holes 138. Since the rails are joined in close proximity, the inner facing edges of the rail base 140 are spiked at a point beyond the ends of the opposing rail. Additional spike holes 142 may also be provided in the vicinity of the rail ends in order to provide greater strength in securing the joining base plate 130 to the tie 46 and also to prevent the rails 128 from displacing in a linear direction, if necessary.

Figure 21:
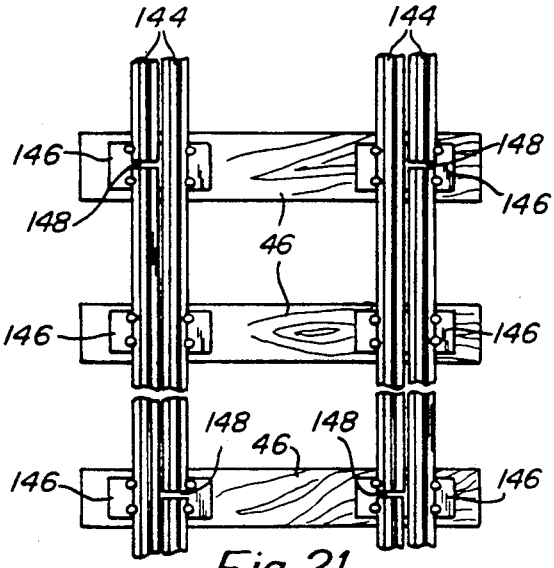
FIG. 21 is a top view of a variation of the embodiment of FIG. 18 showing a gapless rail joint utilizing two sets of staggered, joined rails and center flanged oppositely facing wheels.

A variation of the staggered rail joining system of FIGS. 18-20 is depicted in FIG. 21. Here, two sets of closely spaced continuous rail pairs 144 are spiked in place using double spiking plates 146 to form, essentially, a four rail track. This system eliminates gaps in the same manner as that depicted in FIG. 18 by staggering the gaps 148 of each rail in a rail pair such that no two gaps are placed side by side in the pair. Thus, a center flange wheel unit such as that depicted in FIG. 19 is always supported by at least one rail as it traverses a gap in the other rail of the pair. This rail pair arrangement has additional advantages in that it more effectively guides a train at high speeds and also allows for supporting of heavier loads.

Figure 22:
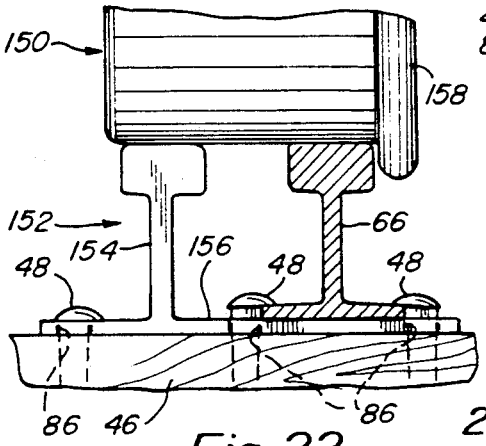
FIG. 22 is an alternative type of wheel for use with various embodiments requiring specially formed wheels.

As stated above, the center flange wheel of FIG. 19 may be utilized in the embodiments of FIG. 18 and FIG. 21. Additionally, these embodiments, as well as those utilizing oppositely facing standard wheel pairs, may be implemented by utilizing a single inwardly flanged wheel with a substantially axially extended rolling surface, such as the special wheel 150 depicted in FIG. 22. The rolling surface of this wheel is long enough in an axial direction to ensure that part of it always contacts one of either the rail or gap support (or either of two staggered rails). The frame 152 shown in this figure is of the type disclosed in FIG. 13, except that the supporting structure 154, which is integral with the base plate 156, is disposed outwardly from the spiked rail 66. This facilitates placement of the wheel flange 158 at the inner disposed end of the wheel.

Figure 23:
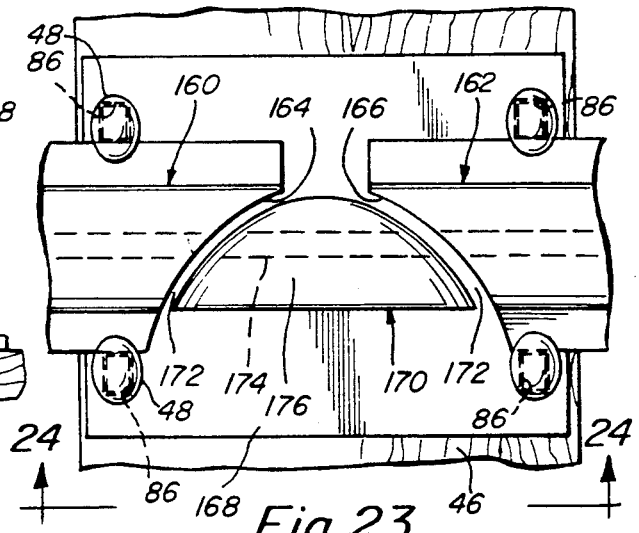
FIG. 23 is a top view of another alternative embodiment of a gapless rail joint according to this invention utilizing a wedge shaped structure in linear alignment with the rails.

Another variation of a gapless rail joint embodiment is depicted in FIG. 23. This embodiment includes a pair of rails 160 and 162 with generally diagonally cut ends 164 and 166. These rails are joined at these ends in linear alignment upon a specially formed base plate 168 that has, integrally constructed upon its center, a wedge structure 170. This wedge structure 170 fills the gap 172 between the two diagonal rail ends 164, 166 and conforms in shape to the diagonal cuts of these ends. Diagonal as referred to herein should be taken to include gaps having a curvature but generally crossing the rail from side to side at an angle of somewhat greater or less than 90 degrees. Therefore, when a wheel enters this gap region, it is always supported by some part of the top surface of either the rail end or the wedge, and the wheel's contacting rolling surface never encounters a complete gap transverse to the direction of travel (and thus parallel to the contacting rolling surface). Even so, the gap is still sufficient along the entire rail end to allow for thermal expansion.

Figure 24:
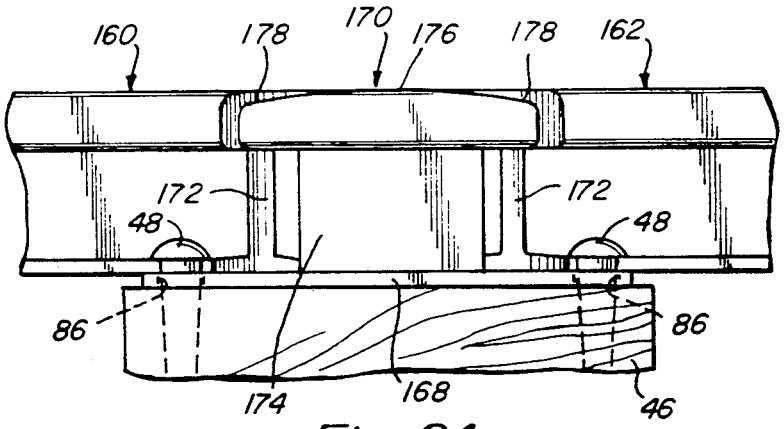
FIG. 24 is a side view of the gapless rail joint of FIG. 23.

As shown in FIG. 24, the wedge rises from the base plate 168 as a web 174, similar to that found upon the rails themselves, and ends at a top surface 176, also similar in shape to that of the rails themselves. In fact, this configuration requires no components extending beyond the normal sides of a rail and, therefore, is suitable for use with any standard wheel at any location along the track. As in other variations of a gapless rail joint embodiment according to this invention, the top surface may include a pair of tapered ramps 178 oriented in the direction of wheel travel in order to facilitate a smooth transition of a wheel from the rail top surface to the wedge top surface and back to the rail top surface as it passes through.

It should be understood that the preceding is merely a detailed description of preferred embodiments. It should be apparent to those skilled in the art that various modifications and equivalents can be made herein without departing from the scope or spirit of the invention. The preceding description is meant to describe only the preferred embodiments and not to limit the scope of the invention.

What is claimed is:

1. A rail joint comprising:

two rails disposed in a direction of wheel travel joined at their ends so as to permit continuous rolling of said wheel from one rail to the other, said rails maintaining said wheel at a predetermined elevation and said ends having a gap therebetween;

means for supporting said wheel in a region overlapping said gap at an elevation equal to said predetermined elevation, said means for supporting including means, disposed laterally along one side of said two rails and bridging said gap, for contacting an outer disposed rolling surface of said wheel at a level that maintains said wheel at said predetermined elevation and said means for supporting further including means, disposed laterally along an opposite side of said two rails and bridging said gap, for carrying a guiding flange of said wheel at a level that maintains said wheel at said predetermined elevation over said gap; and web means passing transversely through said gap and interconnecting said means for carrying and said means for contacting to each other.

2. A rail joint according to claim 1 wherein said means for carrying, said means for contacting and said web means are interconnected and include an integral spike base plate for aligning at least one of said two rails relative to said means for carrying, said means for contacting and said web means.

3. The rail joint according to either claim 1 or 2 wherein at least one of said means for carrying and said means for contacting includes at least one ramp means in the direction of wheel travel that tapers to a level below that required to maintain said wheel at said predetermined elevation.

4. The rail joint according to claim 1 wherein said wheel includes a substantially axially extended rolling surface.

5. A rail joint as set forth in claim 1 wherein the web means includes a top surface disposed at least partially at said predetermined elevation proximate said means for contacting.

6. A rail joint as set forth in claim 1 wherein each of said means for carrying, said means for contacting and said web means are joined to a spike plate means having holes for spikes to join said rail ends thereto.

7. A rail joint as set forth in claim 6 wherein each of said means for contacting and said means for carrying comprise substantially planar plates having a spacing from each other that decreases along a direction taken from said spike plate means to a top surface of said rails.

8. A rail joint as set forth in claim 7 wherein the means for carrying includes a trough disposed along a top surface thereof in a direction of wheel motion for stabilizing said guiding flange in a direction transverse to wheel motion.

9. A structure for supporting a wheel at a rail joint comprising:

a pair of rails joined at their ends with a gap therebetween, said rails each supporting a wheel at a predetermined elevation;

means for supporting said wheel in a region overlapping said gap and substantially at said predetermined elevation, said means for supporting including first support means bridging said gap and disposed laterally on one side of said rails for support of a first portion of said wheel, second support means also bridging said gap and disposed laterally on an opposite side of said rails for support of a guiding flange of said wheel, and web means passing transversely through said gap and interconnecting said first and said second support means.

10. The structure according to claim 9 wherein said first support means includes a top surface equal in height to a top surface of at least one of said rails.

11. The structure according to claim 9 wherein said second support means includes a lip disposed in a direction of wheel travel and facing an opposite side of said guiding flange from a side of said guiding flange faced by a rail side, said lip rising to an elevation above that required to support said wheel at said predetermined elevation whereby said guiding flange is prevented from moving substantially away from said rails in a direction transverse to wheel motion.

12. A structure as set forth in claim 9 wherein the web means includes a top surface disposed at least partially at said predetermined elevation proximate said means for contacting.

13. A structure as set forth in claim 9 wherein each of said first support means, said second support means and said web means are joined to a spike plate means having holes for spikes to join said rail ends thereto.

14. A structure as set forth in claim 13 wherein each of said first support means and said second support means comprise substantially planar plates having a spacing from each other that decreases along a direction taken from said spike plate means to a top surface of said rails.

15. A structure as set forth in claim 9 wherein said first portion comprises an outwardly disposed rolling surface of said wheel.

16. A structure as set forth in claim 15 wherein the first support means includes a trough disposed along a top surface thereof in a direction of wheel motion for stabilizing said guiding flange in a direction transverse to wheel motion.

* * * * *